US008820963B2

(12) United States Patent
Olsen et al.

(10) Patent No.: US 8,820,963 B2
(45) Date of Patent: Sep. 2, 2014

(54) SOLID STATE LIGHT FIXTURE WITH A TUNABLE ANGULAR DISTRIBUTION

(75) Inventors: Joseph Allen Olsen, Gloucester, MA (US); Michael Quilici, Essex, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 213 days.

(21) Appl. No.: 13/159,798

(22) Filed: Jun. 14, 2011

(65) Prior Publication Data

US 2012/0319616 A1 Dec. 20, 2012

(51) Int. Cl.
*F21V 5/00* (2006.01)
*H05B 37/02* (2006.01)

(52) U.S. Cl.
USPC ..... 362/244; 362/227; 362/235; 362/249.02; 362/268; 315/151; 315/152; 315/158; 315/291; 315/294

(58) Field of Classification Search
USPC ..... 315/151, 152, 158, 291, 294; 362/227, 362/235, 244, 249.02, 268
See application file for complete search history.

(56) References Cited

U.S. PATENT DOCUMENTS

| | | | | |
|---|---|---|---|---|
| 5,227,762 | A * | 7/1993 | Guidette et al. | 340/12.34 |
| 6,102,552 | A * | 8/2000 | Tullis | 362/249.06 |
| 2002/0196639 | A1* | 12/2002 | Weidel | 362/521 |
| 2004/0130891 | A1 | 7/2004 | Twardawski | |
| 2009/0128866 | A1* | 5/2009 | Okamoto et al. | 358/498 |
| 2011/0141754 | A1* | 6/2011 | Hikmet et al. | 362/464 |
| 2011/0253056 | A1* | 10/2011 | Fredricks | 119/247 |

FOREIGN PATENT DOCUMENTS

| | | | |
|---|---|---|---|
| DE | 102008027909 | A1 | 4/2010 |
| EP | 1422467 | A2 | 5/2004 |
| EP | 2065634 | A2 | 6/2009 |
| WO | WO02/06723 | A1 | 1/2002 |
| WO | WO 0206723 | A1 * | 1/2002 |

OTHER PUBLICATIONS

Machine Translation by EPO and Google of specification of WO02/06723 published Jan. 24, 2002 by Sirona Dental Systems GMBH.
PCT/US2012/040271 International Search Report mailed Nov. 12, 2012.
Machine Translation by EPO and Google of specification of EP2065634 published May 26, 2004 by Simellert SLT GMBH.

* cited by examiner

*Primary Examiner* — Douglas W Owens
*Assistant Examiner* — Thai Pham
(74) *Attorney, Agent, or Firm* — Andrew Martin

(57) ABSTRACT

A light fixture may include LEDs that each emits light into a particular zone on a lens, where each zone has its own focal properties. Each LED may be grouped into one (or more) subset(s) that corresponds to the zone(s) struck by its emitted light. The LEDs may be selectively electrically controllable, so that the amount of light transmitted through each zone may be controllable by the electrical control system of the fixture. Because light transmitted through different zones emerges from the fixture having different widths, the electrical control system can directly control the amount of light emerging at each width. By mixing relatively narrow light with relatively wide light in the proper proportions, the electrical control system of the fixture may produce light having any desired angular profile between "narrow" and "wide".

20 Claims, 8 Drawing Sheets

SOLID STATE LIGHT FIXTURE WITH A TUNABLE ANGULAR DISTRIBUTION

TECHNICAL FIELD

The present invention relates to a light fixture having an adjustable angular distribution, and a method of varying said angular distribution.

BACKGROUND OF THE INVENTION

Many light sources for general illumination, such as linear fluorescent fixtures and some parabolic aluminized reflector lamps, typically have a fixed angular distribution of light that is a property of the light source. For instance, if a particular fixed-width light fixture is designated as having a "wide" beam, the fixture generally cannot be adjusted easily to produce a "narrow" beam.

An improvement to the fixed-width fixture is an adjustable-width fixture. Typically, these fixtures rely on mechanical movement to produce a change in the width or distribution of the output beam. For instance, moving a source relative to a reflector or a lens may produce a change in the output beam width. As another example, an adjustable aperture or iris may be used to block light that falls outside a desired beam width.

These known adjustable-width fixtures may have several disadvantages. First, they may be prone to failure because they include moving parts, which can wear with time. Second, they may be inconvenient to adjust because they may be out of reach. Third, for the case of the iris that blocks the periphery of the output beam, a significant fraction of the output light may be wasted.

Accordingly, there exists a need for a light fixture that has the flexibility to adjust its output beam profile, but overcomes the disadvantages stated above.

SUMMARY OF THE INVENTION

An embodiment is a light fixture. The light fixture includes a lens, which has a lateral area divided into a plurality of zones. Each zone has a respective focal length. The light fixture includes a plurality of selectively electrically controllable light emitting diodes (LEDs) disposed longitudinally adjacent to the lens. The plurality of LEDs emit light in essentially the same direction toward the lens with essentially the same spectral profile. Each LED in the plurality emits light that strikes one of the zones. Each LED belongs to a subset of LEDs corresponding to the zone struck by its emitted light. Each zone produces a transmitted beam having a respective angular beam width. The transmitted beams from the plurality of zones form exiting light. At least two of the zones produce transmitted beams having different respective angular beam widths. Each subset of LEDs is electrically controllable independent of the other subsets. A variation in electrical power to one subset of LEDs relative to the other subsets of LEDs produces a change in the angular profile of the exiting light.

Another embodiment is a light fixture. The light fixture includes a plurality of selectively electrically controllable light emitting diodes (LEDs). The plurality of LEDs emit light in essentially the same direction with essentially the same spectral profile. The light fixture also includes a plurality of lenses corresponding to at least some of the plurality of LEDs. Each lens that receives emitted light from a corresponding LED produces a transmitted beam having one of a predetermined number of angular beam widths. Each LED that does not have a corresponding lens produces a transmitted beam having one of the predetermined number of angular beam widths. The LEDs are grouped into mutually exclusive subsets by the respective angular beam width. The transmitted beams form exiting light. At least two of the transmitted beams have different angular beam widths. Each subset of LEDs is electrically controllable independent of the other subsets. A variation in electrical power to one subset of LEDs relative to the other subsets of LEDs produces a change in the angular profile of the exiting light.

A further embodiment is a method for varying an angular distribution from a light fixture. The method includes: providing a localized plurality of selectively electrically powered light emitting diodes (LEDs), the plurality of LEDs emitting light in essentially the same direction with essentially the same spectral profile, the light from each LED having one of a predetermined number of angular beam widths, the light from the plurality of LEDs forming exiting light; providing electrical power to a first subset of the plurality of LEDs, the first subset producing light having a first angular beam width; and varying the electrical power provided to a second subset of the plurality of LEDs, the second subset producing light having a second angular beam width different from the first angular beam width.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION OF THE INVENTION

In this document, the directional terms "up", "down", "top", "bottom", "side", "lateral", "longitudinal" and the like are used to describe the absolute and relative orientations of particular elements. For these descriptions, it is assumed that the light fixture is mounted overhead, such as being incorporated into a ceiling tile or ceiling grid, and that the light fixture directs its output generally downward toward a user. It will be understood that while such descriptions provide orientations that occur in typical use, other orientations are certainly possible. For instance, the fixture may be wall-mounted or incorporated into additional elements to provide indirect lighting.

The noted descriptive terms, as used herein, still apply to the fixture, even if the fixture has an orientation other than overhead, or is uninstalled in its overhead orientation.

A light fixture having a controllable angular distribution is disclosed. The fixture may include a lens with a lateral area divided into zones, with each zone having a particular focal length. The fixture may include LEDs located behind the lens, where each LED emits light into one zone on the lens. Light from the LEDs may emerge from each zone with an angular beam width that can vary from zone to zone. The LEDs corresponding to a particular zone may be electrically controlled independently of the other LEDs for the other zones, so that the amount of light with a particular angular beam width may be increased or decreased with respect to the other light transmitted through the lens. In some cases, when the electrical power to the LEDs for one zone is varied, the electrical power to the other LEDs is varied in a complementary manner, so that the total optical power of the exiting light remains constant. In other cases, when the electrical power to LEDs for one zone is varied, the electrical power to the other LEDs remains constant. By varying the relative contributions of the different beam widths, the angular profile of the total output may be varied, and may advantageously be varied electronically, without any moving parts.

Figure 1:
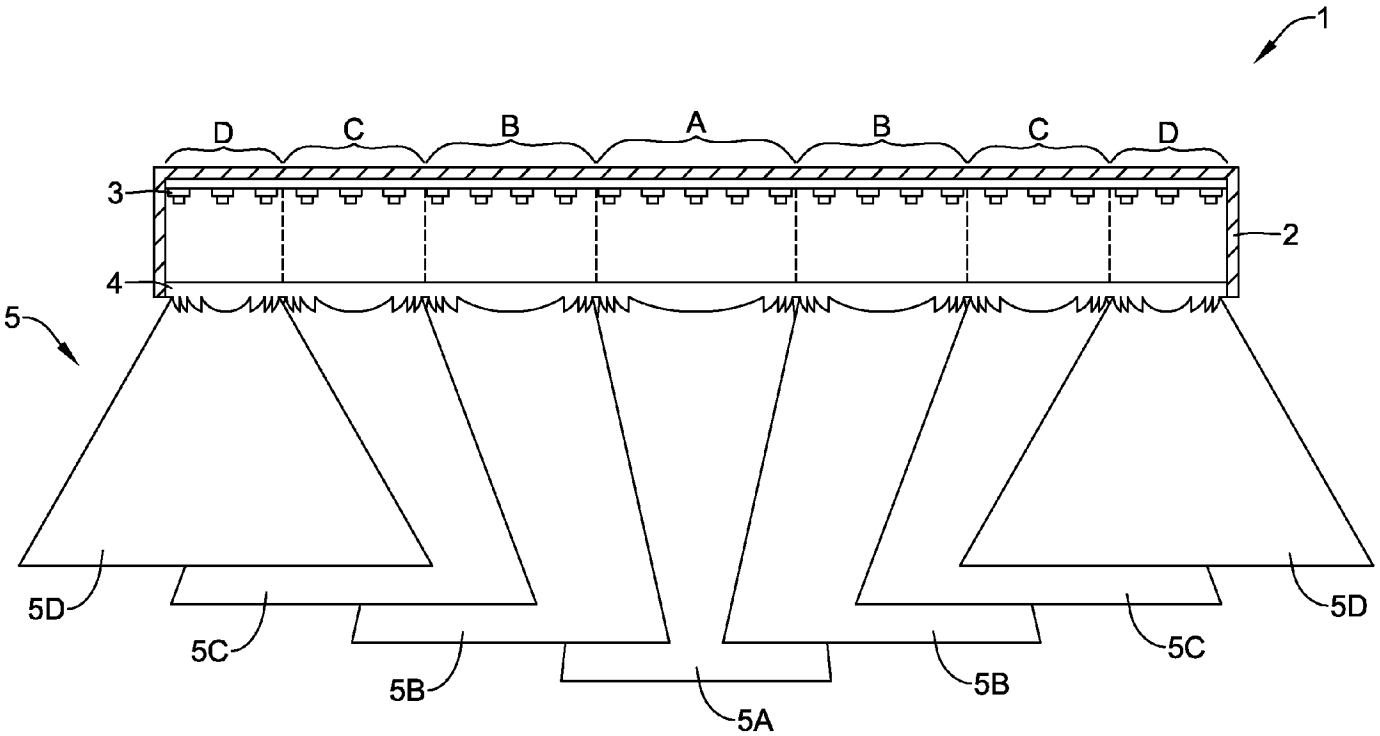
FIG. 1 is a cross-sectional drawing of an example light fixture.

FIG. 1 is a side-view cross-sectional drawing of an example light fixture 1. Such a fixture 1 may be an overhead fixture for an office environment, such as the kind typically incorporated into a ceiling tile in a hanging grid. Alternatively, the fixture 1 may be a stand-alone unit, such as a spotlight for theaters.

There is some geometrical terminology that describes the fixture 1, which is independent of the specific application. Light emerges from the fixture 1 with a distribution that is centered along a longitudinal axis. In FIG. 1, the longitudinal axis is vertical, and light emerges downward. For an overhead light fixture, the longitudinal axis is also vertical, and light also emerges downward. For a theatrical spotlight, the longitudinal axis points from the fixture to the stage, which is often generally downward and forward for light fixtures mounted near the ceiling of the theater. A plane perpendicular to the longitudinal axis may be referred to as lateral. For overhead light fixture, the plane of the ceiling or ceiling tiles may be considered lateral. For a theater spotlight, lateral may refer to planes parallel to the "front" of the fixture, through which the light exits. In general, the exiting surface may be referred to as the front of the fixture (looking end-on) or the bottom of the fixture (as in FIG. 1). Likewise, the surface opposite the exiting surface may be referred to as the back of the fixture or the top of the fixture (as in FIG. 1). Although the aspect ratio of an overhead lighting fixture is generally short and wide, and that of a theater spotlight is generally tall and narrow, the functionality of the fixture elements is generally the same, and the spatial relationships between them are generally also the same. In this document, the drawings show the generally short and wide dimensions for the typical overhead configuration, but it will be understood that any suitable aspect ratio may be used.

The light fixture 1 may include a housing 2. For a ceiling-mounted fixture 1, the housing 2 may include a metal or plastic exterior, suitable mountings for the internal components, and a perimeter sized appropriately for a hanging grid in an office environment, which typically has grid elements spaced apart by 24 inches. For a theater spotlight, the housing may have a cylindrical exterior, and may optionally include mounting elements that can position the spotlight appropriately and can clamp the spotlight to a mounting rail or other support structure. The housing 2 may have a back side, shown at the top of FIG. 1, and a front side, shown at the bottom of FIG. 1. Light emerges from the front side.

The LEDs 3 emit light generally downward in FIG. 1, toward a lens 4. The lens 4 has a lateral area, typically along the front face of the fixture 1, which is divided into different zones, denoted as A, B, C, and D in FIG. 1. Each zone may have a different focal length or different focal property, so that light 5 transmitting through the lens 4 may have an angular beam width that varies from zone-to-zone. For instance, light 5D leaving the lens 4 in a peripheral zone D may be wider than light 5A leaving the lens 4 in a central zone A. In some cases, the zones are arranged concentrically on the lens 4. In some cases, such as for an overhead office fixture, the zones may be arranged as concentric squares. In some cases, the concentric zones have increasingly wide angular beam widths from a central zone to a peripheral zone. In some cases, there are two zones. In other cases, there are three zones. In the example of FIG. 1, there are four zones. More than four zones may alternatively be used as well.

In some cases, the fixture 1 may include an internal structure or structures that ensure that light from a particular group of LEDs strikes a particular zone and does not leak into adjacent zones. An example of such an internal structure may be reflective, scattering and/or absorbing walls between the zones, which may be located in the fixture 1 of FIG. 1 where the vertical dashed lines are, between the LEDs 3 and the lens 4. Such walls may have different lengths and/or different angles with respect to the plane of the fixture, so as to better direct light and separate the zones.

Figure 2:
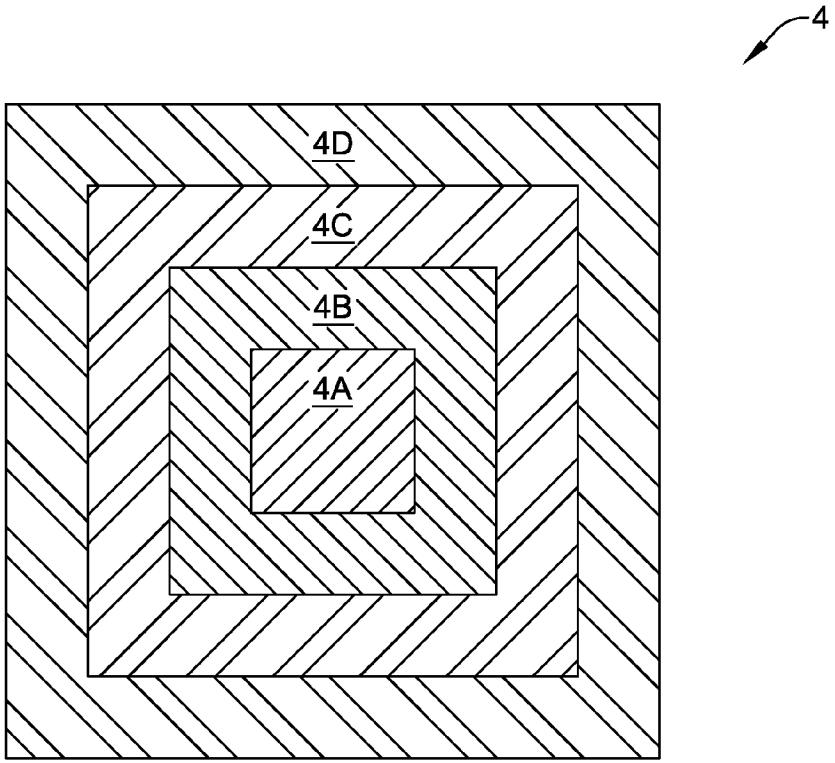
FIG. 2 is a bottom-view drawing of the lens of FIG. 1.

FIG. 2 is a bottom-view drawing of the lens 4 of FIG. 1. The four concentric, square zones of the lens are shown as 4A, 4B, 4C and 4D, corresponding to zones A, B, C and D from FIG. 1. In some cases, the square zones shapes may be practical for overhead lighting fixtures and their incorporation into ceiling tiles. For other applications, such as some theater spotlights, the footprint of the lens 4 may be round instead of square, and the lens 3 may use round zones instead of square zones.

Figure 3:
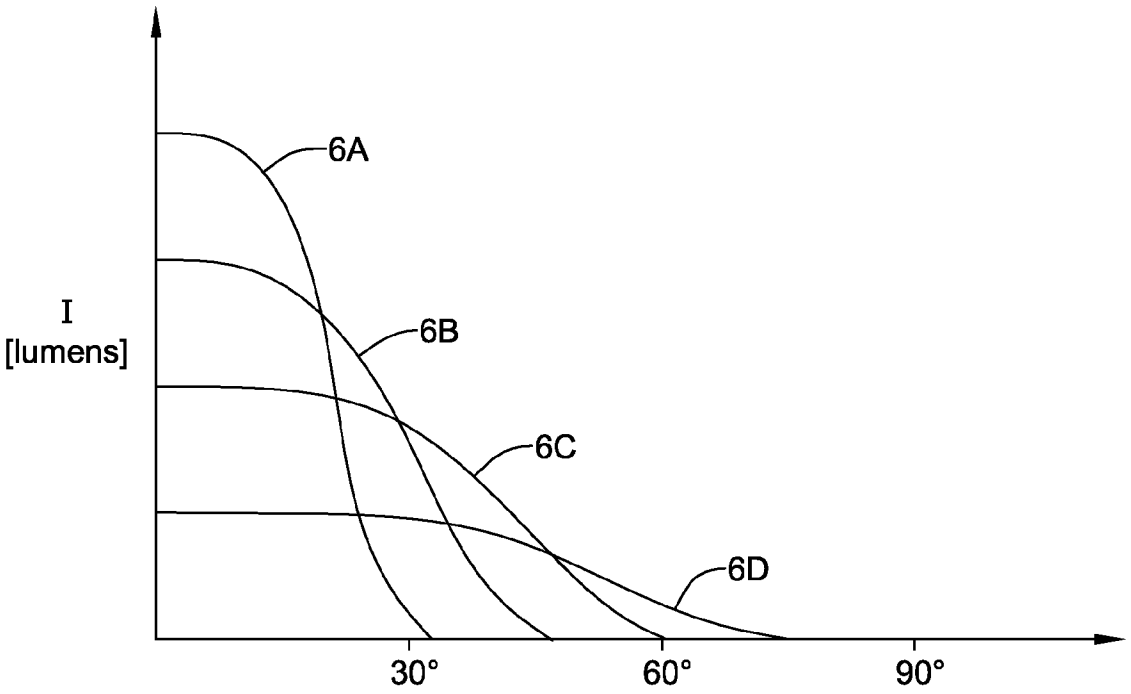
FIG. 3 is a plot of the relative power per angle versus angle of the light emerging from each of the four zones of the lens of FIG. 1.

FIG. 3 is a plot of the relative power per angle 6A, 6B, 6C and 6D versus angle of the light emerging from each of the four zones A, B, C and D, respectively. For all four zones, the light shows the peak power per angle at 0 degrees, which is parallel to the longitudinal axis of the fixture 1, and falls to zero at some point away from the longitudinal axis. The angular beam widths for each zone are different, with the most narrow being the central zone A and the widest being the peripheral zone D. Note that the plots of FIG. 3 are merely an example, and that other suitable curves may also be used. Note also that the order of wide and narrow zones may be randomized and/or reversed, if desired.

The fixture includes one or more light emitting diodes (LEDs) 3 as the light source. In some cases, the LEDs 3 are all the same color, as is typically the case for an office environment. More specifically, the LEDs 3 may all have the same color spectral profile, so that light at one width appears to have the same color as light at another width. In other cases, the LEDs 3 may include different colors, such as red, green or blue, so that the fixture may emit a desired color at a particular time, as may be the case for a theater spotlight that illuminates particular changing scenes on the stage.

The light emerges from each LED 3 as an angular distribution, with different amounts of optical power traveling in different directions away from the LED 3. The LEDs 3 in the light fixture 1 are typically mounted so that the peak amount of optical power is generally parallel to a longitudinal axis of the light fixture, which is downward in FIG. 1. At angles away from vertical, the optical power decreases with increasing angle, and ultimately falls to zero at 90 degrees away from vertical. In other words, essentially no light propagates away from the LEDs in the lateral direction.

Mathematically, the angular distribution from each LED 3 can be described by a central axis, which in the fixture 1 is generally coincident with the longitudinal axis of the fixture 1, and a description of how the optical power per angle decreases away from the central axis. In many cases, the beam width can be described by a full-width at half-maximum (FWHM) of optical power at a particular angle, which is usually expressed in degrees. There are other, generally equivalent, expressions that can convey a beam width, such as an angle at which the optical power per angle decreases to 50% (or 20%, 5%, 1/e, $1/e^2$, and so forth) of a maximum value.

For the special case of a bare LED chip, the light distribution can be well represented by a Lambertian distribution, in which the optical power per angle decreases with a cosine dependence at angles away from its peak value. The FWHM of the Lambertian distribution is $2\cos^{-1}(0.5)$, or 120 degrees.

For some applications, the Lambertian distribution of the bare LED chip may be too wide, so a lens may be included with each LED chip. Typically, these lenses may be hemispherical in shape, with the chip at or near the center of the hemisphere. Such hemispherical lenses may reduce the emitted beam width by roughly a factor of the refractive index of the hemisphere. In general, such hemispherical lenses may be incorporated into the LED packaging and may be readily commercially available. The LEDs 3 in the light fixture 1 may or may not use such lenses, and the optional hemispherical lenses are not shown in FIG. 1.

The lens 4 itself may be a refractive and/or diffractive element, such as a Fresnel lens, or a microlens array. A Fresnel lens or microlens array may be advantageous in that it may be relatively thin, may be stamped or molded from a relatively lightweight plastic material or glass, and may include a relatively complex pattern without introducing complications into the manufacturing process. Such a lens or lens array may easily have a pattern that is sectioned into zones, with each zone having its own focal properties.

The LEDs 3 may be grouped so that each LED 3 emits primarily into one zone, although there may be some spillage of light into an adjacent zone. Such spillage may be ignored, or may be accounted for in the simulation stage of the light fixture 1, typically before any parts are built. In some cases, the LEDs 3 may be clustered in the zone area, and may optionally be spaced away from the boundaries between the zones.

Each group of LEDs 3 may be selectively electrically controllable, so that the amount of light transmitted through the lens in each zone may be electrically controlled as well. The electrical control system for the fixture 1 has the flexibility to direct more or less light through a zone, simply by increasing or decreasing the electrical power supplied to the respective LEDs 3 in that zone.

As a result, the electrical control system for the fixture 1 can change the angular profile of the exiting light, by mixing and matching the appropriate amounts of light from the relatively wide and relatively narrow zones. For instance, if the narrowest possible light is desired from the fixture 1, the electrical control system may supply electrical power only to those LEDs 3 that correspond to the most narrow zone, which is zone A in FIG. 1. Similarly, if the widest possible light is desired from the fixture 1, the electrical control system may supply electrical power only to those LEDs 3 that correspond to the widest zone, which is zone D in FIG. 1. For intermediate beam profiles between the most narrow and the widest, the electrical control system may supply electrical power to at least two of the zones simultaneously in the desired proportions. The exiting light is then formed from the zones, may have a desired angular profile formed as the sum of the different beam widths from the respective zones. In some cases, the light from the zones is spatially superimposed; in other cases, each zone produces light that may be adjacent to light from the other zones.

In this manner, the fixture 1 may produce light with any desired profile between "narrow" and "wide", and may do so without moving any parts in the fixture 1. The absence of moving parts may be advantageous in that the fixture 1 may not suffer from wear on the elements and may therefore be less prone to failure.

In some cases, as the electrical power provided to one of the zones is varied, the electrical power provided to the other zones is varied in a complementary manner so that the total optical power of the exiting light remains constant. This may be beneficial for some applications that require a fixed amount of light, but want the light distributed angularly in a particular manner. In other cases, as the electrical power provided to one of the zones is varied, the electrical power provided to the other zones remains constant. This may be advantageous for some configurations of a theater spotlight, in which a central portion of the stage may keep the same illumination, and a peripheral portion of the stage may be additionally illuminated.

We first summarize our findings thus far, then present specific configurations for the LEDs 3 and the lens 4.

A light fixture 1 includes LEDs 3 that each emits light into a particular zone A, B, C, D, on a lens 4, where each zone has its own focal properties. Each LED 3 may be grouped into one (or more) subset(s) that corresponds to the zone(s) struck by its emitted light. The LEDs 3 may be selectively electrically controllable, so that the amount of light transmitted through each zone may be controllable by the electrical control system of the fixture 1. Because light transmitted through different zones emerges from the fixture 1 having different widths, the electrical control system can directly control the amount of light emerging at each width. By mixing relatively narrow light with relatively wide light in the proper proportions, the electrical control system of the fixture 1 may produce light having any desired angular profile between "narrow" and "wide". One may think of the fixture 1 having a controller that features both a dimmer, which can control the optical power or brightness of the fixture 1, and a "width" controller, which can dial in values between "narrow" and "wide" light. By varying the relative contributions of the different beam widths, the angular profile of the total output may be varied, and may advantageously be varied electronically, without any moving parts.

We turn now to discussion of configurations for the LEDs 3 and the lens 4, so that light emerging from the various zones A, B, C and D of the lens 4 has beam widths that depend on the zone.

Generally speaking, there may be three optical elements that contribute to the width of the beam that emerges from a particular zone of the lens 4: the LED chip, an optional hemispherical lens packaged with the LED chip, and the lens 4 itself. Of these three elements, there are four quantities that may be adjusted to vary the emergent beam width: the focal length of the hemisphere (by making it thicker or thinner than a half-sphere), the spacing between the LED chip and the hemisphere, the focal length in a particular zone of the lens 4, and the spacing between the LEDs 3 and the lens 4. Out of all of these combinations, two of more likely are varying the focal length in the lens 4 while keeping all other quantities constant, and varying the spacing between the hemisphere and the LED chip while keeping all other quantities constant. We describe both of these configurations with some basic, first-order mathematics.

Figure 4:
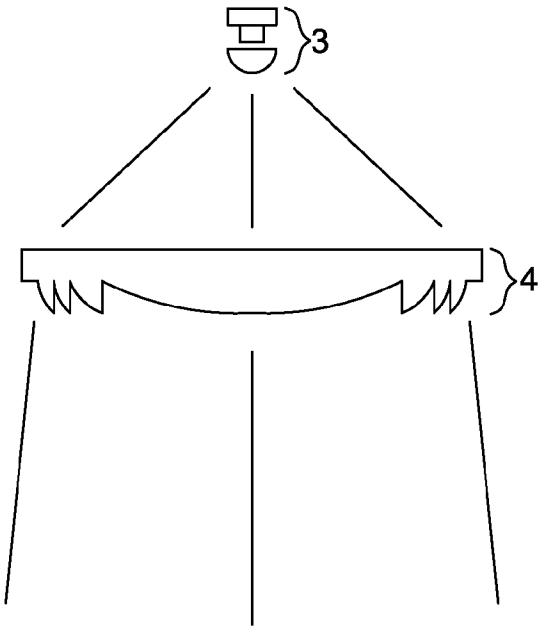
FIG. 4 is a schematic drawing of a first configuration for the zones, in which the focal length of the lens of FIG. 1 is varied from zone-to-zone.

The first configuration, in which the focal length of the lens 4 is varied from zone-to-zone, is shown schematically in FIG. 4. The LED 3 is shown as having a hemispherical lens to reduce its divergence, although the hemispherical lens may be omitted. We define a first-order magnification m of the lens 4 as being the angular beam width below the lens, divided by the angular beam width above the lens. Magnifications for this configuration can range from one, where the lens 4 has essentially no optical power, to zero, where the beam emerging from the lens 4 is essentially collimated. For a magnification m, and an LED-to-lens separation of z, the focal length f of the lens in a particular zone may be given by $f=z/(1-m)$. For the case of $m=1$, the lens 4 may be generally planar or may be omitted entirely. For the case of $m=0$, the LED 3 is essentially at the front focal plane of the lens 4, so that the beam emerging from the lens is essentially collimated. Once suitable values of the angular beam width are chosen, and the LED-to-lens spacing z is chosen, magnifications m may be calculated, and focal lengths f may be calculated. Fabrication of Fresnel lens elements having a desired focal length is known in the art. Each zone in the lens 4 may have a different focal length, and a different Fresnel lens surface profile as well.

As an alternative configuration to that shown in FIG. 4 and FIG. 1, the spacing between the hemisphere 14 and the LED chip 13 may be varied from zone-to-zone, while keeping all other quantities constant. For this configuration, the lens 4 may be omitted entirely, and the function of the "zones" comes from the spacing between the LED chip 13 and the hemisphere 14. Such a spacing may be one of a predetermined number of distances, such as two, three, four, more than four, or however many "zones" is desired. Together, the LED chip 13 and the hemispherical lens 14 may be referred to collectively as the LED 10 or LED element 10.

Figure 5:
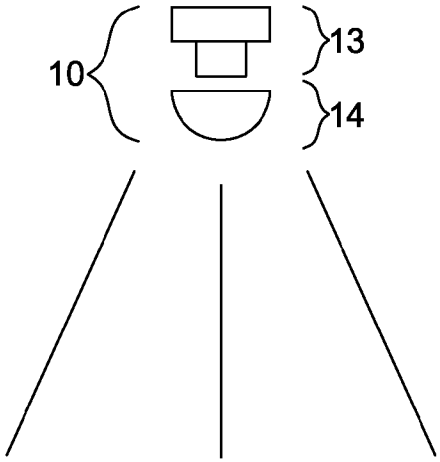
FIG. 5 is a schematic drawing of a second configuration for the zones, in which the spacing between the hemisphere and the LED chip is varied from zone-to-zone.
Figure 6:
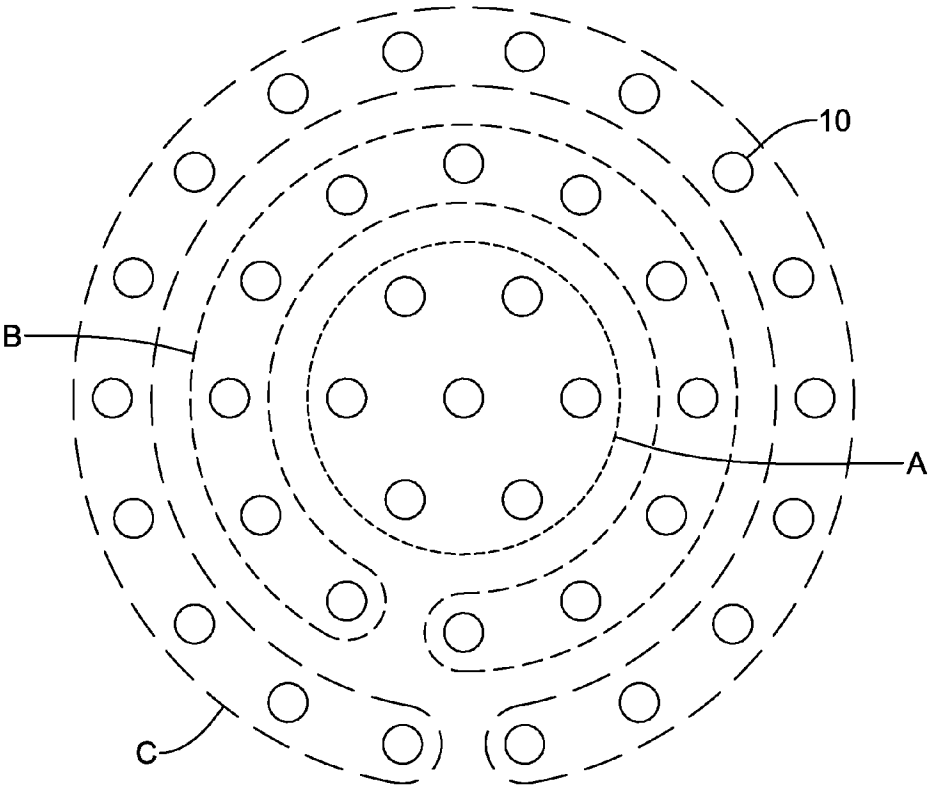
FIG. 6 is a bottom-view drawing of the zone arrangement of the LEDs for the configuration of FIG. 5.

The LEDs 10 may be arranged in a suitable pattern within the fixture 1. The example of FIG. 5 shows the LEDs 10 as having a generally concentric zone pattern, with zones A, B and C having different angular beam widths. In this example, A may be the narrowest, B may be an intermediate, and C may be the widest, although any suitable arrangement may be used. In this configuration, the LEDs 10 in the same zone need not even be clustered together, since there may not be any optical elements following the LEDs 10. It is preferable that the LEDs 10 in each zone be electrically controllable together. The transmitted beams from the LEDs 10 become spatially superimposed, and exit the fixture 1 with their respective widths, to contribute to the total angular profile of the exiting light.

Figure 7:
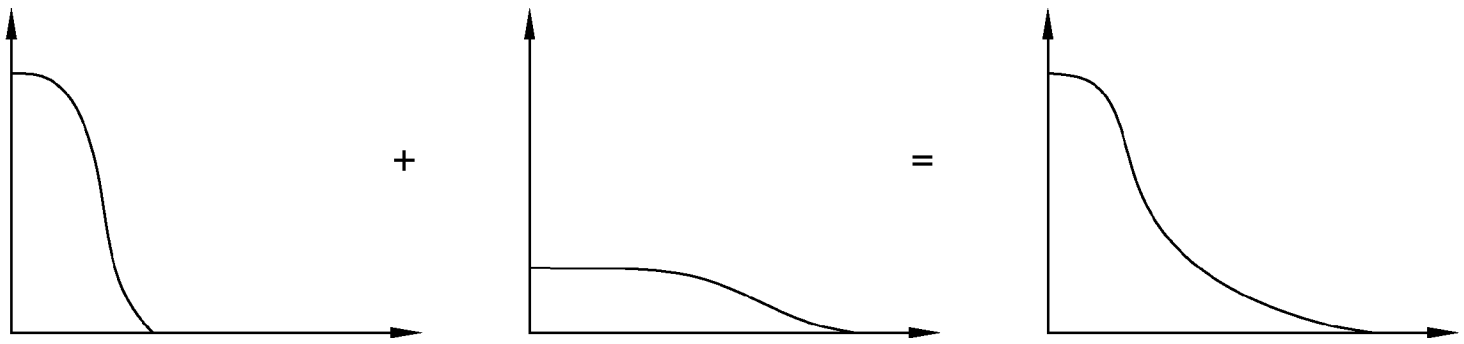
FIG. 7 is an example plot showing the sum of a relatively large amount of narrow light with a relatively small amount of wide light.
Figure 8:
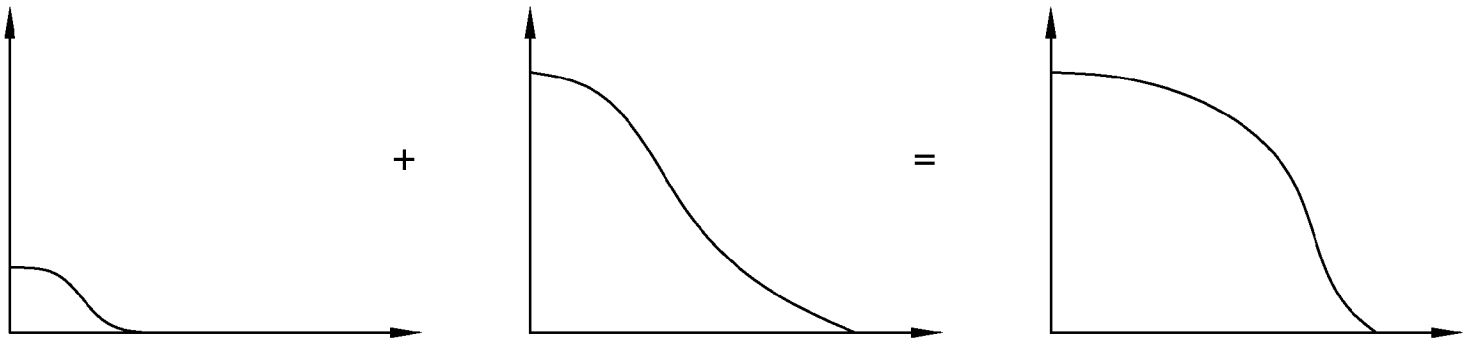
FIG. 8 is an example plot showing the sum of a relatively small amount of narrow light with a relatively large amount of wide light.

In any of the above configurations, the electrical control system for the fixture 1 supplies varying amounts of electrical power to the zones, in response to how much "narrow" versus "wide" light is desired. As a graphical example, FIG. 7 shows that the sum of a relatively large amount of "narrow" light with a relatively small amount of "wide" light is relatively narrow, but is wider than the purely narrow light. Similarly, FIG. 8 shows that the sum of a relatively small amount of narrow light with a relatively large amount of wide light is relatively wide, but is narrower than the purely wide light.

Unless otherwise stated, use of the words "substantial" and "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one, of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A light fixture, comprising:

a lens having a lateral area divided into a plurality of zones, each zone having a respective focal length;

a plurality of selectively electrically controllable light emitting diodes (LEDs) disposed longitudinally adjacent to the lens, the plurality of LEDs emitting light in essentially the same direction toward the lens with essentially the same spectral profile, each LED in the plurality emitting light that strikes one of the zones, each LED belonging to a subset of LEDs corresponding to the zone struck by its emitted light, each zone producing a transmitted beam having a respective angular beam width, the transmitted beams from the plurality of zones forming exiting light;

wherein at least two of the zones produce transmitted beams having different respective angular beam widths;

wherein each subset of LEDs is electrically controllable independent of the other subsets;

wherein the zones are concentric with each consecutive zone completely surrounding the respective zone of the beam having a narrower angular beam width; and wherein a variation in electrical power to one subset of LEDs relative to the other subsets of LEDs produces an adjustment of an angular beam width of the fixture.

2. The light fixture of claim 1, wherein as the electrical power provided to one of the subsets of LEDs is varied, the electrical power provided to the other subsets of LEDs is varied in a complementary manner so that the total optical power of the exiting light remains constant.

3. The light fixture of claim 1, wherein turning off electrical power to one subset of LEDs produces a narrower angular beam width of light provided by the fixture and turning on electrical power to the one subset of LEDs produces a wider angular beam width of light provided by the fixture.

4. The light fixture of claim 1, wherein the zones are concentric and do not overlap.

5. The light fixture of claim 4, wherein the zones are arranged as concentric squares.

6. The light fixture of claim 1, wherein the concentric zones having increasingly wide angular beam widths from a central zone to a peripheral zone.

7. The light fixture of claim 1, wherein the lens has three concentric zones.

8. The light fixture of claim 1, wherein the lens is a microlens array.

9. The light fixture of claim 1, wherein the distances between the LEDs and the lens are fixed; and wherein the focal lengths of the zones are fixed.

10. A light fixture, comprising:

a plurality of selectively electrically controllable light emitting diodes (LEDs), the plurality of LEDs emitting light in essentially the same direction with essentially the same spectral profile; and a plurality of lenses corresponding to at least some of the plurality of LEDs;

wherein each lens that receives emitted light from a corresponding LED produces a transmitted beam having one of a predetermined number of angular beam widths;

wherein each LED that does not have a corresponding lens produces a transmitted beam having one of the predetermined number of angular beam widths;

wherein the LEDs are grouped into mutually exclusive subsets by the respective angular beam width;

wherein the transmitted beams form exiting light;

wherein at least two of the transmitted beams have different angular beam widths;

wherein each subset of LEDs is electrically controllable independent of the other subsets;

wherein a variation in electrical power to one subset of LEDs relative to the other subsets of LEDs produces a change in the angular beam width of the exiting light of the fixture;

wherein a first subset of LEDs having the narrowest of the angular beam widths is disposed at the lateral center of the plurality;

wherein a second subset of LEDs having an intermediate angular beam width surrounds the first subset of LEDs; and wherein a third subset of LEDs having the widest of the angular beam widths surrounds the second subset of LEDs.

11. The light fixture of claim 10, wherein as the electrical power provided to one of the subsets of LEDs is varied, the electrical power provided to the other subsets of LEDs is varied in a complementary manner so that the total optical power of the exiting light remains constant.

12. The light fixture of claim 10, wherein as the electrical power provided to one of the subsets of LEDs is varied, the electrical power provided to the other subsets of LEDs remains constant.

13. The light fixture of claim 10, wherein the transmitted beams have one of three angular beam widths; and wherein the LEDs are group into three mutually exclusive subsets by the respective angular beam width.

14. The light fixture of claim 10, wherein the second subset of LEDs having said intermediate angular beam width completely surrounds the first subset of LEDs; and wherein the third subset of LEDs having the widest of the angular beam widths completely surrounds the second subset of LEDs.

15. The light fixture of claim 10, wherein the angular beam width of each transmitted beam depends on the focal length of the respective lens and on a distance between the respective lens and the respective LED.

16. The light fixture of claim 15, wherein the plurality of LEDs have essentially the same emission characteristics;

wherein the plurality of lenses have essentially the same focal lengths; and wherein the distance between each LED and the corresponding lens is one of a predetermined number of distances.

17. The light fixture of claim 15, wherein the plurality of LEDs have essentially the same emission characteristics; and wherein the plurality of lenses have one of a predetermined number of focal lengths.

18. A method for varying an angular distribution from a light fixture, comprising:

providing a localized plurality of selectively electrically powered light emitting diodes (LEDs), the plurality of LEDs emitting light in essentially the same direction with essentially the same spectral profile, the light from each LED having one of a predetermined number of angular beam widths, the light from the plurality of LEDs forming exiting light;

providing electrical power to a first subset of the plurality of LEDs, the first subset producing light having a first angular beam width; and varying the electrical power provided to a second subset of the plurality of LEDs, the second subset producing light having a second angular beam width larger than the first angular beam width and wherein the second angular beam width substantially surrounding the first angular beam width and results in an adjustment of the angular beam width of the fixture.

19. The method of claim 18, wherein as the electrical power provided to the second subset is varied, the electrical power provided to the first subset is varied in a complementary manner so that a total optical power from the plurality of LEDs remains constant.

20. The method of claim 18, wherein as the electrical power provided to the second subset is varied, the electrical power provided to the first subset remains constant.

* * * * *